United States Patent [19]

Gibbs

[11] Patent Number: 4,569,529

[45] Date of Patent: Feb. 11, 1986

[54] GAME BOARD WITH SLIDES AND CARDS

[76] Inventor: Thomas T. Gibbs, 1539 Edgeward Rd., Victoria, British Columbia, Canada, V8T 2J6

[21] Appl. No.: 669,779

[22] Filed: Nov. 9, 1984

[51] Int. Cl.[4] ..... A63F 3/00

[52] U.S. Cl. ..... 273/274

[58] Field of Search ..... 273/94, 274

[56] References Cited

U.S. PATENT DOCUMENTS 3,921,982 11/1975 Feldman ..... 273/274

4,019,737 4/1977 Witzel ..... 273/94

FOREIGN PATENT DOCUMENTS 2116437 9/1983 United Kingdom ..... 273/274

*Primary Examiner*—Harland S. Skogquist

*Attorney, Agent, or Firm*—Beehler, Pavitt, Siegemund, Jagger & Martella

[57] ABSTRACT

A game. There is a game board having openings on its surface and headings, each indicating an occurrence in a competitive event. Indicia are marked on the board at each side of the openings and slides are received on the board. Each slide extends across an opening between two indicia. A blank portion on each slide aligns with an opening at a first position of the slide. Information on each slide relates to each number on each side of the opening when the slide is moved to a second position. A plurality of cards are included, each with one of the indicia that is also marked at the side of the openings. Thus, on watching a competitive event, as an occurrence takes place the slide is withdrawn at that occurrence space to indicate that the holder of a card with one indicia on it loses and the holder of the card with the aligned indicia wins.

16 Claims, 12 Drawing Figures

GAME BOARD WITH SLIDES AND CARDS

FIELD OF THE INVENTION

This invention relates to a game.

DESCRIPTION OF THE PRIOR ART

The playing of board games is extremely well known and of considerable antiquity. Generally such games involve the throwing of dice, or its equivalent, and the moving of tokens on a marked board. Older games, such as snakes and ladders, are won by one competitor reaching a defined destination before the others. A relatively modern trend, as exemplified by, for example, the game available under the trade mark MONOPOLY, simulate dealings in real estate. Large numbers of board games attempt to simulate competitive events. Examples of prior art that reflect the relatively more sophisticated approach of modern board games are exemplified in the following U.S. Pat. Nos.: 3,110,499 to Boeskool; 4,202,546 to Bromberg; 4,261,569 to Frohlich; 3,528,661 to Warner; 2,585,259 to Marschke; 2,388,577 to Shenker; 1,171,916 to Akins; 4,378,115 to Terrero; and 2,113,369 to Bochicchio.

There have been some attempts to introduce games to be played in which the participants also watch another game, for example on television, and the events in the watched game dictate the course of the board game. An example is the game available under the trade mark ODDS-ON Baseball which involves players wagering by predicting what the players on the batting team in a televised baseball game will do. Wagers are made on a marked portions of a board. Thus, if the participants in ODDS-ON Baseball think a batter will hit a home-run then tokens are placed on that area of the board marked home-run. Such a game requires considerable knowledge of baseball and is not appropriate for the whole family to play.

SUMMARY OF THE INVENTION

In contrast to the above, the present invention seeks to provide a game that requires only rudimentary knowledge of a sporting event and can be played by all members of a family. The game can be played by following a live game or by following a game on television. However in another aspect, the game can be played entirely by itself, that is, the event may be simulated.

The present invention seeks to provide a game that, mathematically over a period of time, allows the rewards and penalties to balance out equally, However, the penalty is equally as high as the reward. This makes the game more intense. The contestants, other than the winning and losing contestants, will have had the pleasure of anticipating a win and the pleasant relief of not having to pay a large penalty.

Accordingly, in a first aspect, the present invention is a game comprising a game board having openings on its surface; headings on the board, each indicating an occurrence in a competitive event; indicia marked on the board at each side of the openings; slides received on the board and each able to extend across an opening between two indicia; a blank portion on each slide to align with an opening at a first position of the slide; information on each slide to relate to indicia on each side of the opening when the slide is moved to a second position; and a plurality of cards, each with one of the indicia that is marked at the side of the openings, whereby upon watching a competitive event, as an occurrence takes place, the slide is withdrawn at that occurrence space to indicate that the holder of a card with one indicia on it loses and the holder of the card with the aligned indicia wins.

DRAWINGS

Aspects of the invention are illustrated, merely by way of example, in the accompanying drawings in which.

Figure 4A:
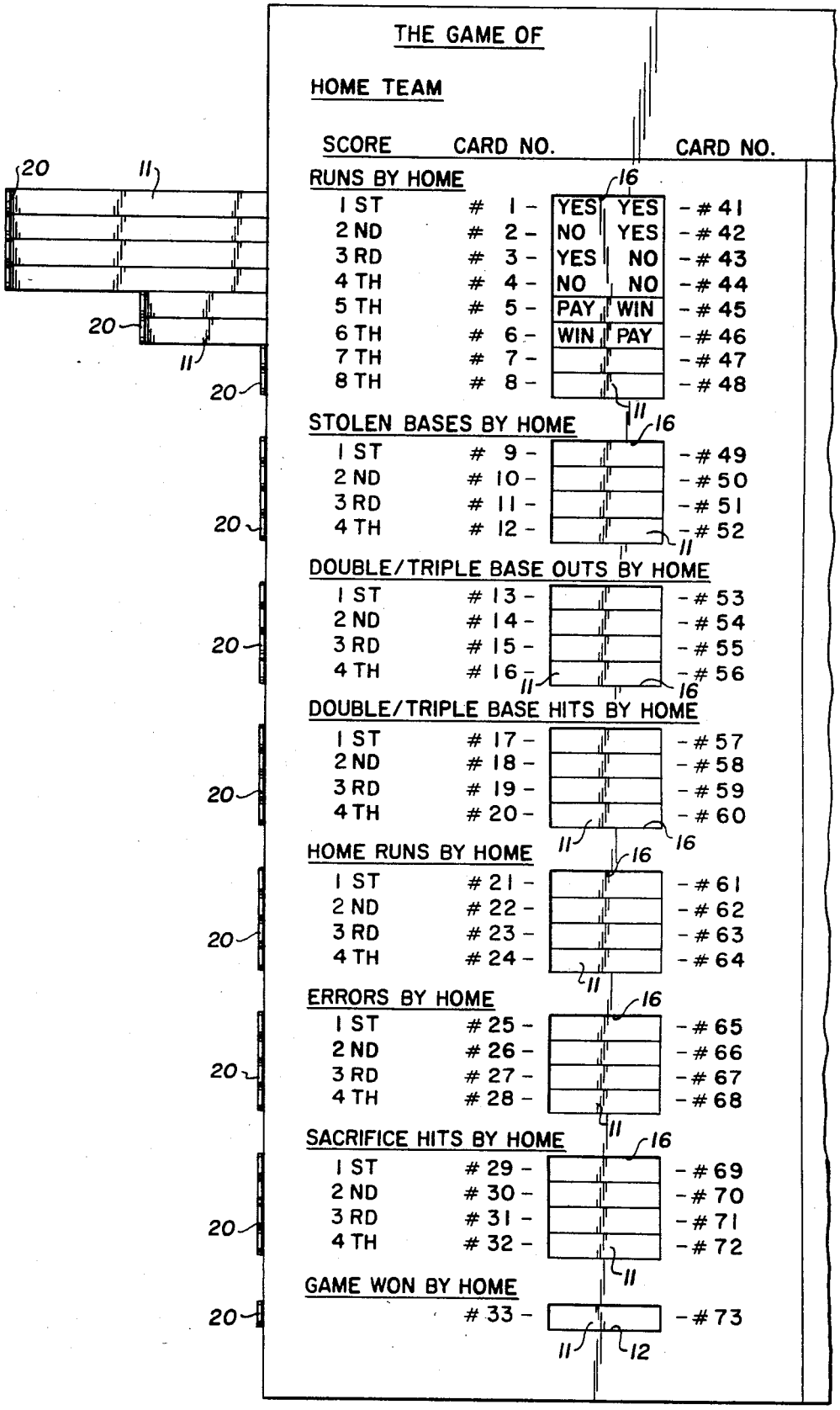
Figure 4B:
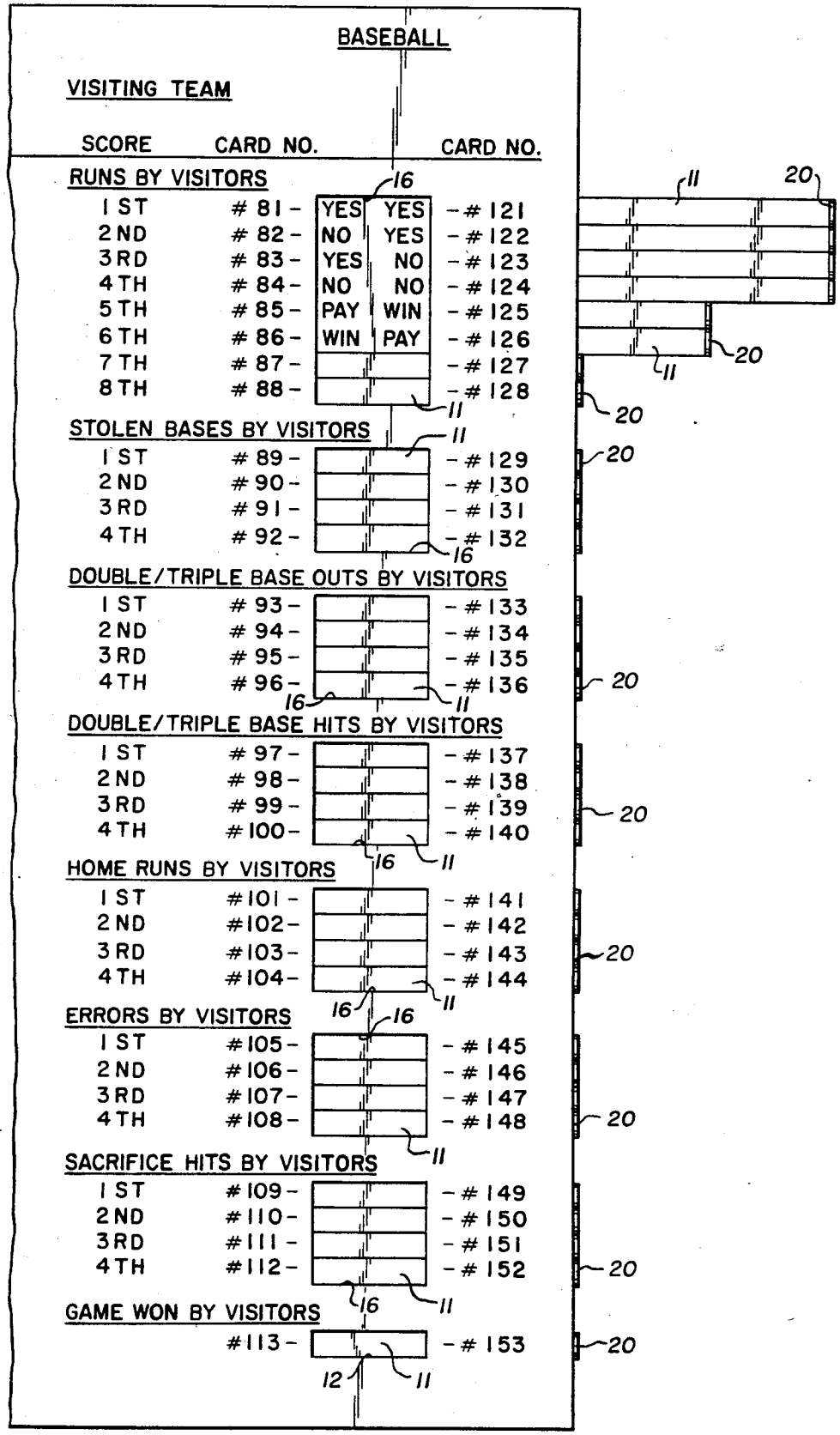

FIG. 4*a* is part of a game board in the present invention useful in the game of baseball;

FIG. 4*b* is the other part of the game board of FIG. 4*a;*

Figure 5:
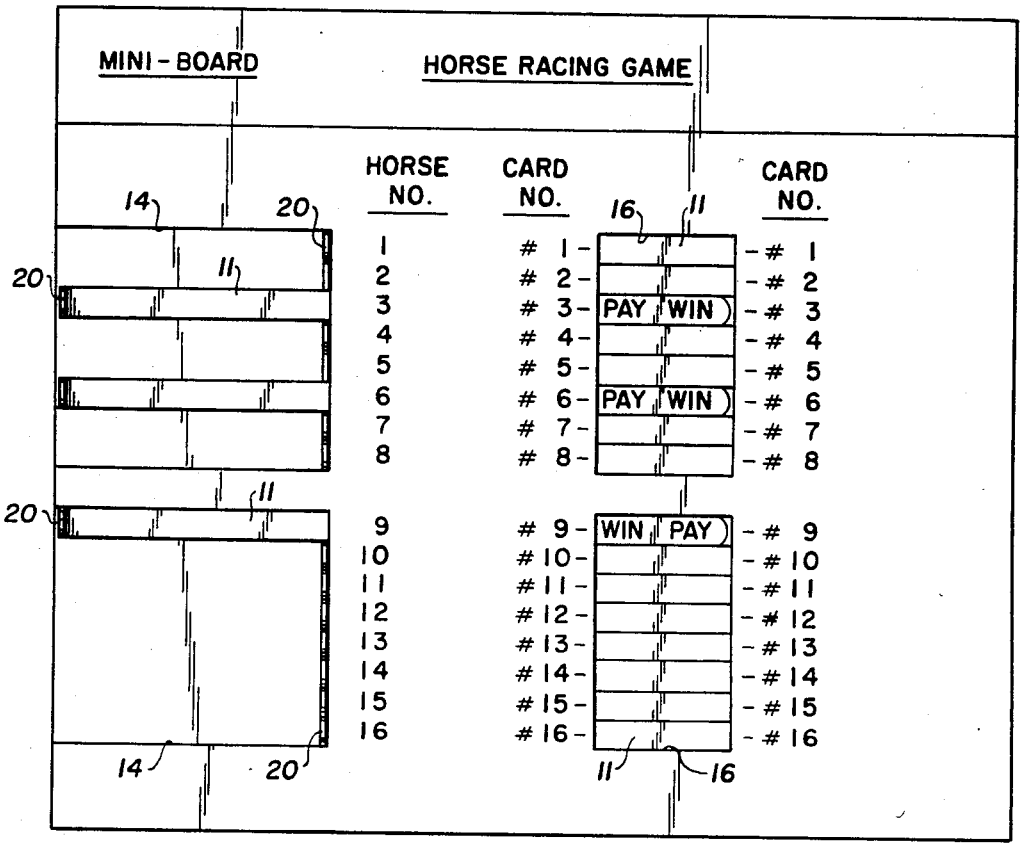
Figure 6A:
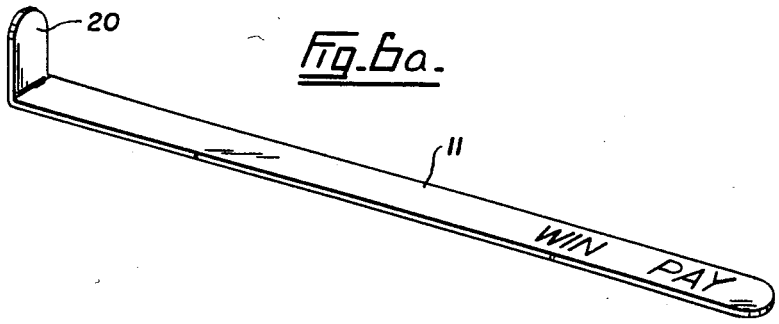
Figure 6B:
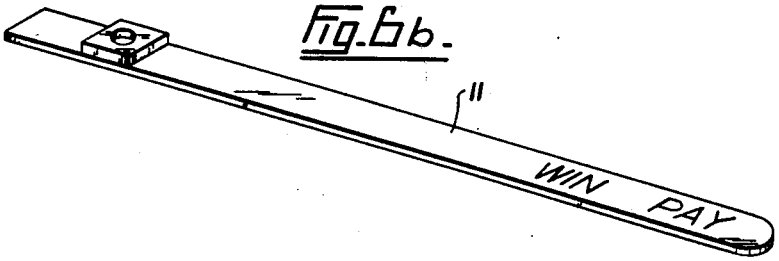

FIG. 5 illustrates a further embodiment of the present invention;

FIGS. 6*a* and 6*b* illustrate slides useful in the game board of FIGS. 1 to 5; and FIGS. 7 to 10 illustrate ancillary cards useful in the game of the present invention.

DESCRIPTION OF THE PREFERRED EMBODIMENTS

Figure 1:
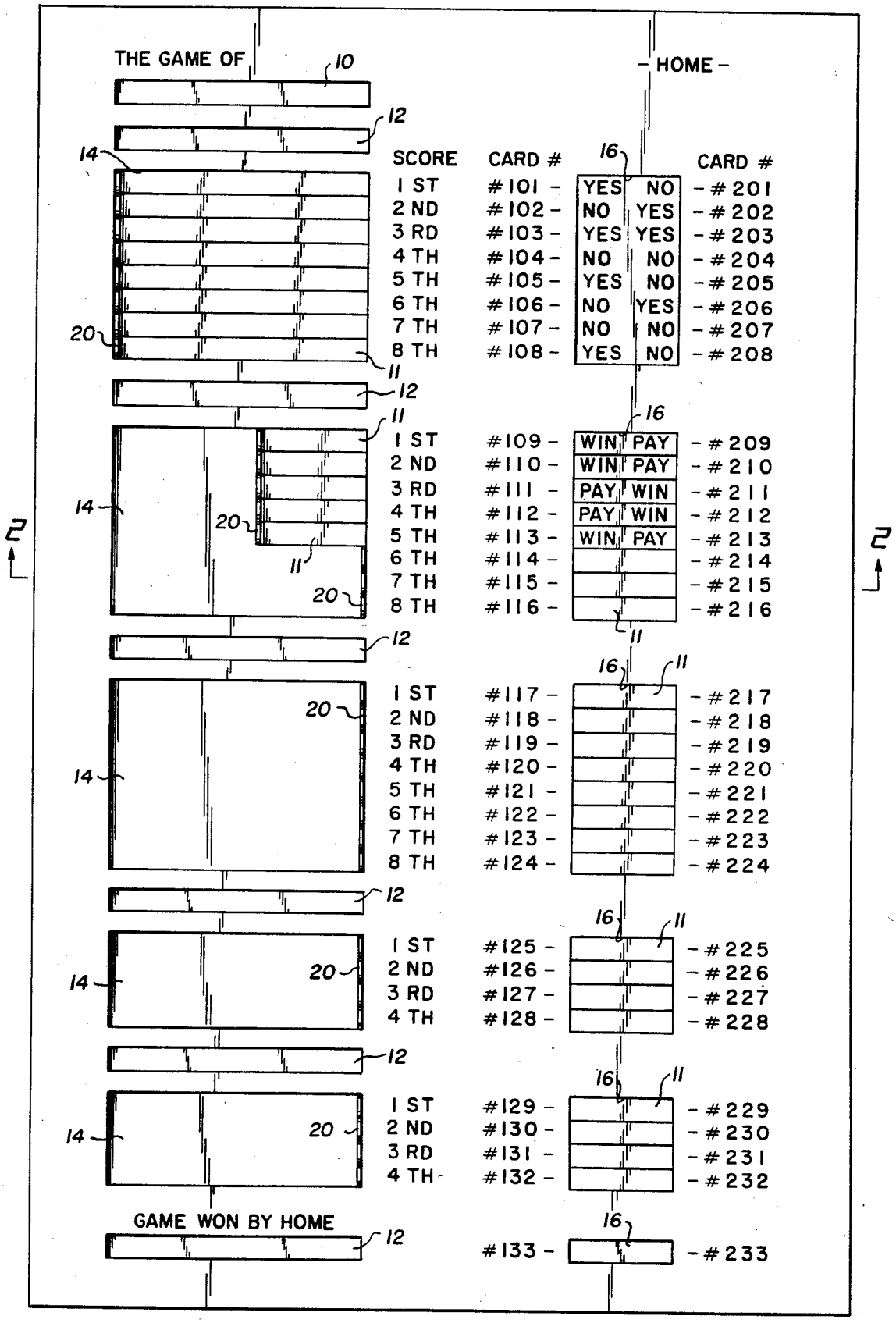
FIG. 1 illustrates part of a game board useful in the game of the present invention.
Figure 2:
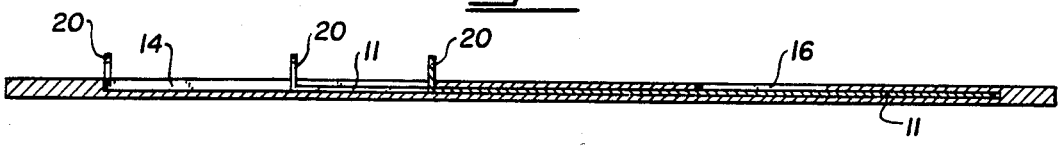
FIG. 2 is a section of the line 2—2 in FIG. 1.
Figure 3:
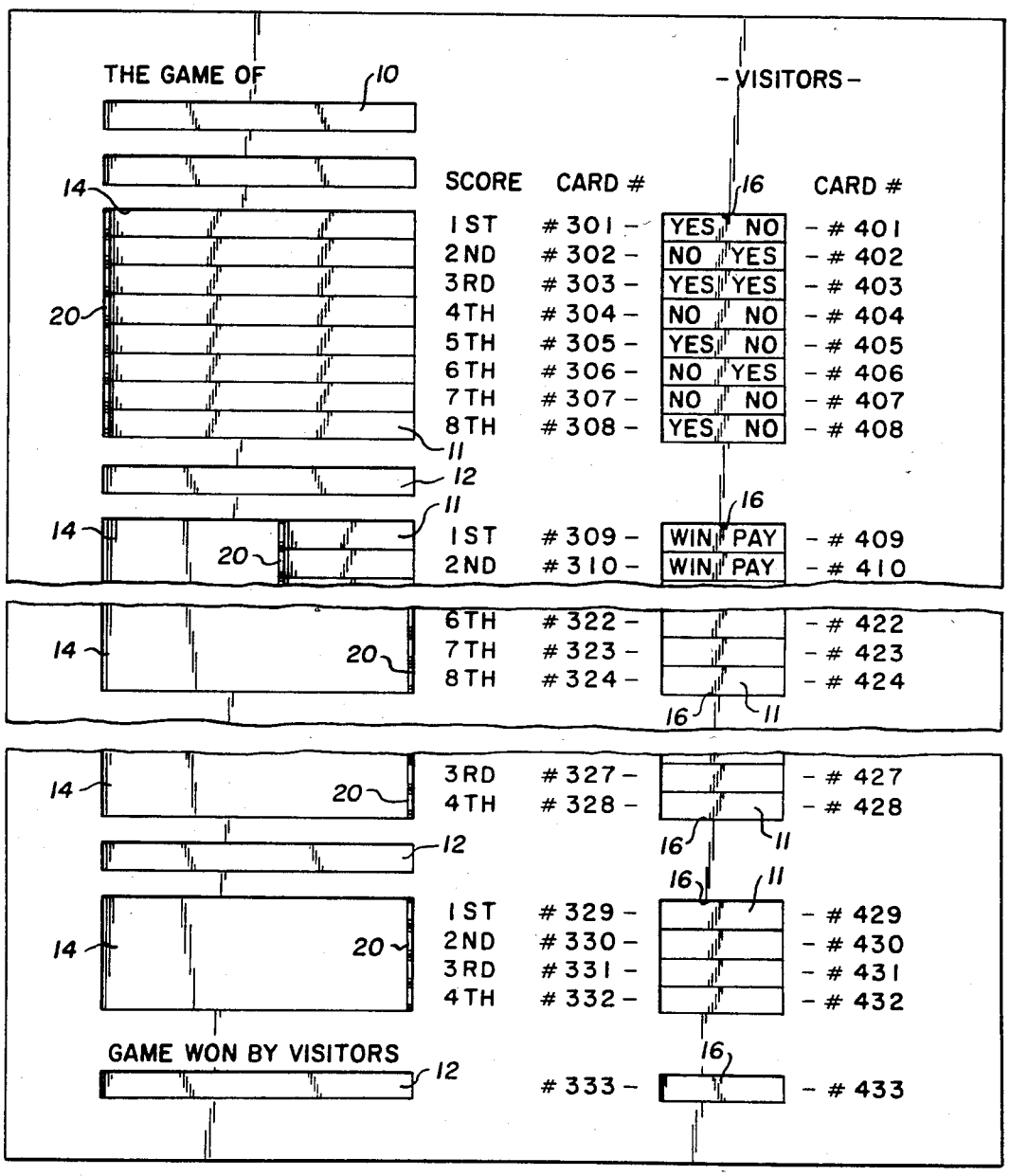
FIG. 3 is a second part of the game board shown in FIG. 1.

FIG. 1 shows a game board useful in the playing of a large number of games. The game board is laminated as shown in FIG. 2, with the lamina adhered at the periphery. The game board has openings in its surface. The drawing of FIGS. 1 to 3 is of an embodiment that is of universal application. That is, the game to be played can vary. Typically a name tag indicating the game being played will be inserted in opening 10 in the top left-hand corner using a slide 11 as illustrated in FIG. 6 but with the name of the competitive event printed on it. Openings 12 will be for headings that reflect an occurrence in the competitive event as shown in the game in the top left-hand corner. For example, referring to FIGS. 4*a* and 4*b,* headings selected from "runs by home", "stolen bases by home", "double/triple base outs by home", "double/triple base hits by home", "home runs by home", "errors by home", "sacrifice hits by home" can be inserted in boxes 12.

Openings 14 in the board, as shown by the numbers to the right of the openings 14, indicate the repetition of the occurrence. For example, in baseball the board shown in FIG. 1 could envisage the possibility of 8 runs by home, 8 bases to be stolen by home, and so on down the board. There are further openings 16 to the right of the board in FIG. 1 marked with monosyllabic answers to questions, again these answers may be obscured by slides 11. In FIG. 1, the answers are printed on the board within the boxes 16 and the slides in the top box 14 are shown fully withdrawn. In the second box 16, most of the slides 11 have been partially withdrawn, sufficient to show the words "win pay", as printed on the slides 11, as particularly shown in FIG. 6. The remaining slides 11 for boxes 16 are shown fully inserted, that is, obscuring both the printing on the slides and the printing on the board.

At each side of boxes 16 are printed numbers. One at each side of a line in each box 16.

FIG. 3 illustrates merely the second part of the board of FIG. 1. As indicated in the top right-hand corner of both boards, FIG. 1 refers to the achievements of the home team, FIG. 3 to the achievements of the visiting team. The numbers marked by the boxes 16 for the visiting team differ from those shown on the boxes 16 for the home team board.

FIGS. 4*a* and 4*b* illustrate, in effect, the same game board as FIGS. 1 and 2 except that the boxes 10 and 12 are not required as FIGS. 4*a* and 4*b* show a game to be played while watching a baseball game.

The operation of the game in FIGS. 1 to 4*b* will now be described. It should be noted that in playing the game of FIGS. 1 and 2 the first step will be to insert printed inserts in boxes 10 and 12 to indicate first the game being played and, secondly, the occurrences in the game or competitive event. Examples of such headings are as follows:

For the game of football, in slot 10 insert the word football, in successive slots 12 insert the words "touchdowns", "conversions", "field goals", "turnovers", and "quarterback sacks".

In baseball, the headings in slots 10 and 12 can be as in FIGS. 4*a* and 4*b* or may be as follows: slot 10 insert baseball, successive slots 12 insert "runs", "stolen bases", "two base hits", "home-runs", and "errors".

For the game of hockey, the following headings may be appropriate: slot 10 insert the word hockey, slots 12 insert the words "goals", "assists", "two minute penalties", "penalty shots" and "hat tricks".

In addition to the board, the game has the items shown in FIGS. 7 to 10, although, as indicated more fully below, all these items may not be used in one game. In a desired form, the game should also include a sample sheet showing the slides 11 and inserts in the correct sequence, and an instruction sheet.

Figure 7:
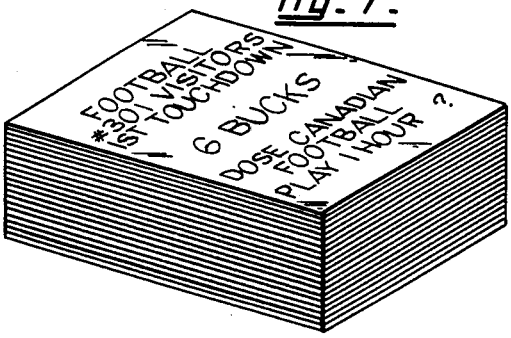

As to the question cards, FIG. 7 shows that such a card has on it a heading indicating the competitive event, a number corresponding to a number by the side of a box 16, identification of either home or visitors team, an indication of an occurrence in football corresponding to a heading in a box 12 in FIG. 1 but printed on the board in FIGS. 4*a* and 4*b*, value for tokens and beneath that a question concerning the sport set out in the heading.

In a first mode, the game is played in conjunction with an attended or watched game, for example, on television, and the game unfolds as plays in each category of the competitive event are made. The question cards are divided amongst the players, the required number of blank question cards being added to the deck to make the division equal. Although the cards of FIG. 7 are called question cards, in fact, in the first mode of the game, to be used while watching a competitive event, the questions printed on the cards are not used. If there are only a small number of players, question cards or complete categories may be eliminated from the deck in order to make card management easier for the players. Tokens are evenly distributed between the players. Each player then contributes a fixed amount of tokens to a kitty to be used later.

The game is then watched on television or live. Players in the televised game control movement of the slide bars 11 which are provided with handles or other gripping means for ease of gripping. For example, with the baseball game, if a run occurs the slide bar aligned with the opening having numbers 81 and 121 on either side is withdrawn if the run is brought in by the visiting team. If the run is brought in by the home team, the slide bar adjacent to the window having the numbers 1 and 41 is withdrawn. The slide is withdrawn sufficiently to reveal one of two possible messages, either pay win or win pay. The players then sort through their cards to find out who holds the numbers on either side of the opening from which the slide has been withdrawn. The player having the card nearer the win marking wins, the other player pays to that player the number of tokens as determined on the token value marked on the question card. That is, the players will bring forward two cards and the amount marked on each will correspond. Thus if win pay occurs in the space defined in the opening boarded by numbers 1 and 41, number 1 wins and number 41 pays to number 1 the amount shown on the cards 1 and 41. If the same player holds both cards then no payment takes place.

The kitty is collected by the overall winner of the game, as indicated in the bottom boxes.

However a prize may be given to the player who wins the greatest number of tokens, excluding the kitty.

Figure 8:
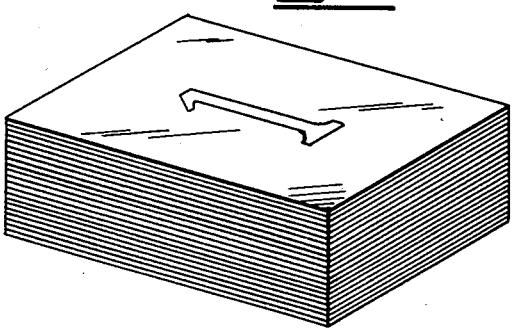
Figure 9:
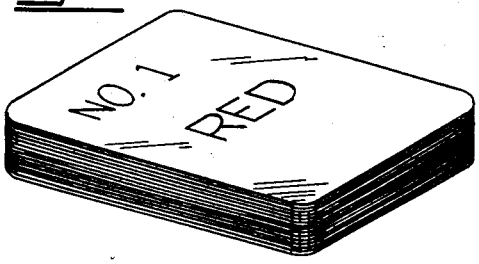
Figure 10:
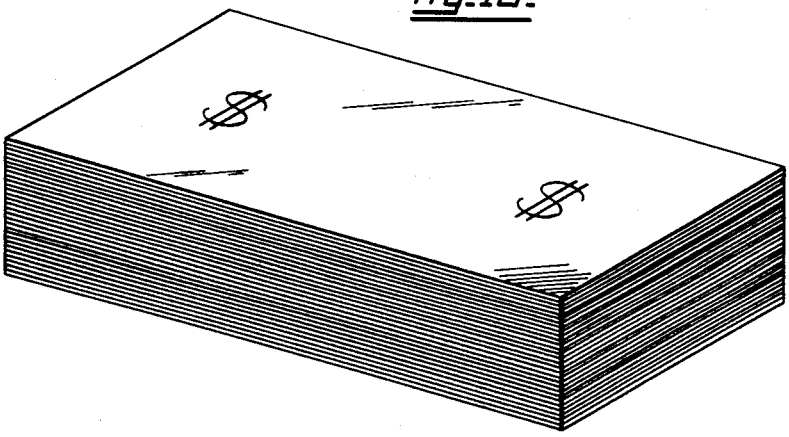

In a second method of operation, not requiring a televised game or a live game, a set of number cards are provided showing numbers from 1 to 132, such cards are shown in FIG. 8, and are used to indicate specific actions and competitors in lieu of seeing actual competitors and plays. This is accomplished by shuffling the pack of numbered cards shown in FIG. 8, placing them face down and drawing the top card. This number corresponds to a question card number and opening 16 number allowing the game to be played as before. That is, as the numbers come up they indicate the category and specific play on the game board. A number of number cards, for example four, may be randomly drawn from the deck and are kept to one side, face down. As the pay offs must be in sequence, for example a first home run must precede all other home runs before any tokens are paid out, these four cards can block further win and pay within random categories and make some question cards redundant. When a card is turned up to unblock a category, all the cards in this category can now be played in sequence. Before the game commences trading of question cards amongst the players is allowed. Cards with the lowest numbers in each category are the most desirable.

In a third mode of operation, the above two modes are ignored and the questions on the question card become important. As a question card is turned up, the question is attempted. For example, the appropriate answer to question 1, shown in FIG. 4*a*, is "yes". In FIG. 3 the appropriate answer to question 404 is "no" and in FIG. 1 the appropriate answer to question 208 is "no". There are no tokens exchanged for answering questions.

The board of FIGS. 1 and 3 can be used for competition between individuals, for example horse racing. The cards used in boxes 12 will specify the race, that is first race, second race etc., as required. In these circumstances, the game may be played while watching horse racing on television or on a video or it could be played while attending a race or by taking the results from the newspaper. Indicia marked on the board at each side of the openings 16 are used to indicate the numbers on the horses in the races. Indicia numbers from 101 to 116 could represent the 16 horses of a race. In this embodiment, horses may be alloted to the players by dealing question cards for one race, for example 101 to 110 and 201 to 210 in a manner similar to before but now card 101 and 201 represent the number one horse, not, for example, the first home run, the first touchdown etc.

After the race is run, only the slide bars associated with the top three horses (win, place and show) are withdrawn to reveal the pay-offs to the participants in the above win/pay scheme. Because only three of the slide bars are removed, this allows some players not to win but to have the enjoyment of playing without the penalty of losing. The payoff is slightly different to the previous modes in that, for example, six tokens may be paid from one player to another when dealing with the winning horse, three tokens for placing and one for showing. The question and the yes/no answer portion still applies but the kitty is not normally used.

In a variation of this procedure, the slide bars may be drawn before the race so that one can see the possible outcome and cheer accordingly.

Trading of question cards before a race is allowed so that one can play the favourites by trading two for one or more.

A shortened version of the individual competitor game, for example horse racing, is shown in FIG. 5, The board in FIG. 5 is used to play a game while watching horse racing on television or video cassette or while attending a race. Alternatively, the results can simply be taken from a newspaper. The winning players and the losers are decided by (a) the number on the winning horses, (b) the holders of the cards with the numbers of the winning horses and (c) the fortuitous draw of the slide bars.

The game is played with a board, 16 slide bars to be mixed and fully inserted, face up, into the board prior to the race. There are 32 horse race cards, two sets of 16 with numbers and colours corresponding to the numbers and colours listed on the board, plus five blank cards. In this regard, the board is marked with a black list on one side of the opening 16 and a list of numbers in red on the other side.

To play the game, the shuffled cards are dealt equally to the players, using blank cards, if needed, to bring up the numbers. The cards not represented by running horses are deleted from the deck. When win, and if desired, place and show are posted, the numbers of the winning horses are checked to find the six cardholders. All the other cards and blanks are now considered void and no tokens are exchanged. The three slide bars on the board adjacent to the numbers of the winning horses are withdrawn. This indicates which three of the six cardholders wins tokens and which three lose tokens.

The amount of payoff may be established by agreement. Suggested amounts may be a win, six tokens; place, 3 tokens and a show, 1 token. Doubles or other combinations must be agreed upon before the race is run. The trading of cards may take place before post time and pairs may be split and traded. In a variation of the game, the slides on the board may be withdrawn prior to the start of the race to reveal which may be the winning and which may be the losing cards. This adds the extra dimension of a player cheering for a horse not to win on the grounds that it is not in the interest of the player for the horse to win.

There are no question cards or number cards used in this shortened version of the individual competitor game.

All matters contained in the above description or shown in the drawings should be interpreted as illustrative, rather than limiting.

I claim:

1. A game comprising:

(a) a game board having:

(i) openings on its surface;

(ii) headings on the board, each indicating an occurrence in a competitive event;

(iii) indicia marked on the board at each side of the openings;

(b) slides received on the board and each able to extend across an opening between two indicia;

(i) a blank portion on each slide to align with an opening at a first position of the slide;

(ii) information on each slide to relate to each number on each side of the opening when the slide is moved to a second position;

(c) a plurality of cards, each with one of the indicia that is also marked at the side of the openings;

whereby:

upon watching a competitive event, as an occurrence takes place the slide is withdrawn at that occurrence space to indicate that the holder of a card with one indicia on it loses and the holder of the card with the aligned indicia wins.

2. A game as claimed in claim 1 including value tokens.

3. A game as claimed in claim 2 in which the cards are marked with the numbers of tokens and the loser pays the winner the number of tokens marked on the card.

4. A game as claimed in claim 1 in which the game board has indicia repeated down the board to allow for a repetition of an occurrence in the competitive event.

5. A game as claimed in claim 1 in which the cards also define the number of tokens to be paid by the loser to the winner.

6. A game as claimed in claim 1 in which each occurrence is set out twice on the board, first to one competitor, second to the opposing competitor.

7. A game as claimed in claim 1 in which the openings in the board are marked with answers to questions, revealed by withdrawal of the slide, and in which each card has a question printed on it so that a player may attempt to answer the question and the slide, on withdrawal, shows a correct responding answer.

8. A game as claimed in claim 1 in which the competitive event represented is a baseball game.

9. A game as claimed in claim 8 in which the headings are (a) runs by the home team, (b) stolen bases by the home team, (c) double-triple base outs by the home team, (d) double or triple base hits by the home team, (e) home runs by the home team, (f) errors by the home team, (g) sacrifice hits by the home team, (h) game won by the home team and repetition of headings (a) to (h) for the visiting team.

10. A game as claimed in claim 1 in which the competitive event is a race between individual competitors, the headings correspond to the race numbers of the individual competitors on the card for the meeting.

11. A game as claimed in claim 1 in which the competitive event is football.

12. A game as claimed in claim 11 in which the headings are touchdowns, conversions, field goals, turnovers, and quarterback sacks, each heading being set up for the home team and repeated for the visiting team.

13. A game as claimed in claim 1 in which the competitive event is hockey.

14. A game as claimed in claim 13 in which the headings are goals, assists, two minute penalties, penalty shots and hat tricks, these headings being repeated for the home and visiting teams.

15. A game as claimed in claim 1 in which the game board is a composite board on which a plurality of games can be played, the board including means to allow the insertion of different headings appropriate for different competitive events.

16. A game as claimed in claim 1 in which the competitive event is simulated.

* * * * *